US007087568B2

(12) United States Patent
Smets

(10) Patent No.: US 7,087,568 B2
(45) **Date of Patent: *Aug. 8, 2006**

(54) PROCESS FOR MAKING A DETERGENT PRODUCT

(75) Inventor: Johan Smets, Lubbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 240 days.

This patent is subject to a terminal disclaimer.

(21) Appl. No.: 10/168,880

(22) PCT Filed: Dec. 20, 2000

(86) PCT No.: PCT/US00/34831

§ 371 (c)(1),
(2), (4) Date: Dec. 9, 2002

(87) PCT Pub. No.: WO01/46365

PCT Pub. Date: Jun. 28, 2001

(65) Prior Publication Data

US 2003/0211960 A1 Nov. 13, 2003

(30) Foreign Application Priority Data

| | | |
|---|---|---|
| Dec. 22, 1999 | (EP) | 99870277 |
| Apr. 13, 2000 | (EP) | 00870070 |
| Jun. 22, 2000 | (EP) | 00202168 |

(51) Int. Cl.
*C11D 11/00* (2006.01)

(52) U.S. Cl. ..... 510/444; 510/276; 510/101; 252/183.11; 424/405

(58) Field of Classification Search ..... 510/444, 510/276, 101; 252/183.11; 424/405
See application file for complete search history.

(56) References Cited

U.S. PATENT DOCUMENTS

| | | | | |
|---|---|---|---|---|
| 5,066,641 | A * | 11/1991 | Narula et al. | 512/25 |
| 5,188,753 | A * | 2/1993 | Schmidt et al. | 510/395 |
| 6,093,690 | A * | 7/2000 | Chapman | 510/444 |
| 6,248,703 | B1 * | 6/2001 | Finucane et al. | 510/152 |
| 6,413,920 | B1 * | 7/2002 | Bettiol et al. | 510/101 |
| 6,451,751 | B1 * | 9/2002 | Busch et al. | 510/349 |
| 6,511,948 | B1 * | 1/2003 | Bettiol et al. | 510/101 |
| 6,699,823 | B1 * | 3/2004 | Bettiol et al. | 510/101 |
| 6,740,713 | B1 * | 5/2004 | Busch et al. | 525/417 |
| 6,764,986 | B1 * | 7/2004 | Busch et al. | 510/101 |

FOREIGN PATENT DOCUMENTS

| | | |
|---|---|---|
| EP | 0 430 315 A2 | 6/1991 |
| EP | 0 971 021 A1 | 1/2000 |
| EP | 1 067 173 A1 | 1/2001 |
| EP | 1 067 174 A1 | 1/2001 |

* cited by examiner

*Primary Examiner*—Lorna M. Douyon
(74) *Attorney, Agent, or Firm*—Brahm J. Corstanje; Kim William Zerby; Steven W. Miller

(57) ABSTRACT

The present invention provides a process for making a viscous reaction product and making this into a solid or suspendable component, so that it can be incorporated in solid and liquid compositions such as cleaning compositions or for example fabric care compositions. The process comprises the steps of: a) reacting at least two compounds with one another to form a first active material to form a viscous mixed product which has a viscosity of at least 500 cps or even at least 1000 cps at 20° C., thereby preferably mixing this with a second active material; b) mixing the product of step a) with a liquid carrier material, (which can then be suspended in a liquid composition); or if slid components are required, step b) being followed by: c) mixing the mixture of step b) with a solid granulation agent to form a solid component; d) optionally forming the solid component of step c) into granules. In particular, the process is for the production of fabric care components such as perfume components, or antimicrobial components.

21 Claims, No Drawings

PROCESS FOR MAKING A DETERGENT PRODUCT

This application is a 371 of PCT/US00/34831 filed Dec. 20, 2000 which claims priority under 35 U.S.C. 119 to European Patent Office (EPO) 99870227 filed Dec. 22, 1999, European Patent Office (EPO) 00870070 filed Apr. 13, 2000, and European Patent Office (EPO) 00202168 filed Jun. 22, 2000.

TECHNICAL FIELD OF THE INVENTION

The present invention relates to process for making viscous condensation or addition products and making granules of these viscous products; the products are typically active materials to be deposited efficiently onto surfaces, such as fabrics.

BACKGROUND OF THE INVENTION

Certain fabric cleaning actives or fabric care actives are intended to be deposited onto the fabrics during the washing operation. For example soil release polymers, brighteners, photo-bleaches, fabric enhancing actives such as softeners, but also perfumes need to be deposited onto the fabric such that they are still present after rinsing and drying of the fabric and still during use. In other applications, not related to fabric care or fabric cleaning, actives are equally required to deposit and remain for a certain time onto a surface, for example insect repellent, drugs, antimicrobials.

In particular when the actives are expensive, it is important that the actives are deposited efficiently and that they have a certain fabric substantivity, so that no (or not too much) actives are wasted, e.g. rinsed out.

A problem with for example perfumes is not only that the amount of perfume carried-over from an aqueous laundry or cleaning bath onto fabrics is often marginal, but also that the perfume which does remain on the fabric after the wash does not last long on the surface and/or does not give a long lasting perfume odour.

Therefore, there is a need to provide a more efficient and effective delivery of actives to surfaces, such as fabrics, for example for improvement in the provision of long-lasting of fabric enhancing actives, antimicrobials, or fragrance to the surfaces like fabrics or hair, or drugs or insect repellent to the skin or hair.

It has been found that by providing a condensation or addition products of such actives with certain reagents, results in active materials which deposit better onto the fabric. It has been found that the efficiency of the deposition of such product can be further improved when these condensation products have a very high viscosity, of at least 400 cps, more preferably 5000 or even 10,000 at 20° C. Typically, more active material or other active material, to be deposited as well, is added to the reaction product (without being reacted), thereby retaining the high viscosity.

Whilst this viscosity is essential to get an efficient deposition onto surfaces, the high viscosity brings as a problem that it is difficult to incorporate these materials into formulations, such as solid and even liquid detergent compositions.

The inventors have found a very simple, economic process for making such reaction products with such a high viscosity and making this into granules or suspendable droplets or particles. The process can be a batch process, in one vessel, or it can be a continuous process. The process is also such that the components formed, release the actives (for example into the wash) in a very dispersed manner (in the from of droplets), so not only effective deposition is achieved, due to the high viscosity, but also a very even deposition is achieved.

The process is useful for the making and further processing of any highly viscous reaction product, typically an addition reaction product or a condensation reaction product to be deposited onto a surface and to be formed into solid form or suspended particle or droplet form.

SUMMARY OF THE INVENTION

The present invention relates to a process for making a viscous reaction product and making this into a solid component, typically as a single vessel batch process or as a continuous process, comprising the steps of:

a) reacting at least two compounds with one another to form a first active material to form a viscous mixed product which has a viscosity of at least 400 cps or even at least 1000 cps at 20° C. or even at least 5000 cps or even at least 10,000 cps, at 20° C., preferably thereby also mixing this with a second active material;

b) mixing the product of step a) with a carrier material; which is suspendable in liquids as suspended particles or droplets;

or the mixing of step b) is followed by step c and optionally step d):

c) mixing the mixture of step b) with a granulation agent to form a solid component; and a) preferably forming the solid component of step c) into granules.

When the component is for incorporation into solid products, such as solid cleaning or fabric care products described herein after, step b) is followed by step c) and optionally step d). However, when the component is for inclusion in liquid products, aqueous or non-aqueous, the mixture of step b) can be directly added to a liquid products, such as a liquid cleaning product or fabric care product. The mixture is such that it from a finely dispersed suspension of particle or droplets of the viscous reaction product/mixture.

In step a), the reaction is preferably a condensation reaction or Michael addition reaction, preferably an esterification and/or Schiff's Base reaction and/or amidation reaction, preferably whereby at least one of the materials is an amine compound which is reacted with an aldehyde, ketone, ester, nitrile and/or mixtures thereof, preferably the amine compound being an amine-based polymer. Preferably no free-moisture is present during this reaction.

Preferably, in any one or more of steps a) to d) also thickening agent is added, or one of the compounds reacted is a polymer and a cross-linking compound is added in the process.

Typically, the reaction product of step a) and/or one of the compounds reacted in step a) is an active material to be deposited on a surface, such as a detergent ingredient or fabric care ingredient (such as a perfume mix, brightener, soil release polymer, softening agent, bleaching agent), or a malodour masking agent or an biocidal agent (such as an antimicrobial agent or insect repellent), or a drug (such as a skin treatment).

Preferably, a second active material is also added in step a), and preferably this is (also) an active material to be deposited onto a surface, such as described above.

The invention also relates to certain solid or suspendable components, but preferably granules, obtainable by certain processes herein and cleaning composition or fabric care composition comprising such solid components or granules.

DETAILED DESCRIPTION OF THE INVENTION

Process

In step a) of the process of the invention, a reaction product is formed which has a viscosity of at least 400 cps or even at least 1000 cps at 20° C. or even at least 5000 cps or even at least 10,000 cps, at 20° C. Preferably, the viscosity is from 1500, or even 5000, up to 20,000,000 cps or even up to 15,000,000 or even up to 12,000,000 or more preferably from 10,000 to 1,000,000 cps, most preferably from 10,000 to 100,000, or even up to 50,000.

The viscosity as used herein is measured on a rheometer, TA Instrument $CSL^2_{100}$ at a temperature of 20° C. with a gap setting of 500 micrometers. The viscosity as used herein is the viscosity of the reaction product (first active material), or if in step a) a second active material is added, the viscosity is of the mixture of the reaction product and added second active material, as specified above.

This has been found to provide effective deposition onto the surface to be treated and to ensure that it remains on the surface for a period of time after the treatments, after the rinse, drying and at least partially in use.

Preferred reactions are condensation reactions and/or Michael addition reactions. Preferred are esterification and/or Schiff's base reactions and/or amidation reactions/and/or polymerisation reactions (which of course can also be amidation reactions or Schiff's base reactions and/or esterification reactions). Preferred compounds to be reacted are described herein after.

The reaction, in particular when this is a condensation or addition reaction, is preferably conducted without the presence of added free-moisture. Thus, the reactants are preferably moisture free and even preferably anhydrous, and no moisture is deliberately added during the reaction. The reaction may even be conducted under such conditions to avoid introduction of atmospheric moisture, such as under nitrogen atmosphere. Moisture free means herein typically less than 2% by weight of the total of the reacting compounds of free moisture, preferably less than 1% or even less than 0.5%, by weight.

It may be preferred that the reaction is conducted under increased temperatures from 30° C. to 150° C. or even to 100° C. or even up to 70° C. or even up to 50° C. Preferably the temperature is controlled such that the reaction product (first active material) is also from 30° C. to 150° C. or even to 100° C. or even up to 70°. This not only can improve the reaction efficiency, but also makes step b) easier to do, because it reduces the viscosity to some extend.

The reaction is typically such that the compounds to be reacted are intimately mixed. Preferably, mixing with a speed of 150 rpm or more, preferably 150 to 350 rpm or even 200–250 rpm is used herefor. Preferred equipment herefor include Twin Screw Extruders (TSE). Suitable TSE include the TX-57 MAG, TX-85 MAG, TX-110 MAG, TX-144 MAG, or TX-178 MAG twin screw extruder from Wenger. Preferred for use herein are the TX-57 MAG and TX-85 MAG. Then, the shaft speed of these TSE's is preferably 150 rpm or more, preferably 150 to 350 rpm or even 200–250 rpm.

TSE suitable for use herein preferably comprise at one of their extremities, called herein after "first part of the TSE", distinct inlets for the compounds to be reacted and also one or more inlets at about the middle of the TSE, so called hereinafter "second part of the TSE", to introduce the carrier, described hereinafter. The second active material can be added in either part of the TSE, preferably through one of the inlets in the first part of the TSE.

Temperature controllers are also distributed along the TSE, to typically control the temperatures as set out above.

Still, an alternative process for making reaction product and forming it in to suspendable mixtures or granules is by a batch process using a mixing tank in which the compounds are reacted and then mixed with the carrier material and then optionally with he granulation agent, if solid components are required. However, a continuous process is preferred for ease of handling, efficiency and in particular for improved control of granulation and particle size and homogeneity.

Typically, a second active material is mixed in step a) with the reaction product (first active material); then, the above viscosity requirements and temperature requirements apply to this mixture.

When a second active material is added in step a), the weight ratio of the reaction product (first active material) to the second active material in step a) is typically from 8:1 to 1:20, more preferably from 4:1 to 1:9, preferably from 2:1 to 3:7. The addition of such additional active material can also help to get the required viscosity. Of course the main advantage is that this active material benefits also from the improved deposition and fabric substantivity and ease of processing.

In step b), the first active reaction product of this viscosity, typically mixed with the second active material, is then mixed with a liquid carrier material, typically by pouring or spraying the viscous product/mixture in the carrier, or preferably dispersing the viscous product/mixture in the liquid carrier material. This is preferably done such that the viscous product/mixture is dispersed in droplets, preferably of a mean particle size of 1 to 300 microns, more preferably from 1 to 150 or even to 100 microns or even to 50 or even 40 microns, and it may be preferred that the lower limit is from 5 or even 10 or even 20 microns.

The liquid carrier is preferably a material which is solid at room temperature, e.g. below 25° C. or even below 30° C., and is liquid due to the temperature of the equipment wherein the mixing takes place and/or the temperature of the product or mixture of step a). Thus, the carrier material has preferably a melting point above 30° C. Preferably, the temperature of the product of step a) and/or the carrier material is such that the carrier material is in its molten state, preferably the temperature of the carrier material and/or the reaction product/mixture of step a) is between 30° C. and 100° C., preferably between 40° C. and 80° C. or even between 50° C. and 80° C.

The weight ratio of the carrier material to the reaction product/mixture of step a) is preferably from 1:4 to 20:1, more preferably from 1:2 to 15:1, more preferably from 1:1 to 10:1.

The resulting mixture of step b) is typically homogeneously mixed, due to the high speed mixing, as described above. Also this mixture is preferably free of added, free-moisture as described above.

The mixture resulting from step b) can be stored prior to further processing it into liquid finished compositions such as fabric care composition or cleaning compositions. It may also be stored prior to step c), but it may be preferred that step c) and d) follow immediately when solid components are required.

The mixture of step b) can be mixed with the granulation agent in step c) in any manner, including spraying or dispersing the mixture on the granulation agent. Preferably however, the mixture is poured on the granulation agent.

Preferably, step c) is just as step a) and b) conducted without the addition of free-moisture (water) and preferably the granulation agent is free of free-moisture or water, preferably the granulation aid is anhydrous.

Step c) and even step b) may be conducted in the same equipment as steps a) and b). For example, the mixture of step b) can be mixed with a granulation agent and formed into granules in an extruder, for example by pumping the mixture through a die plate with one or more holes and forming the extruded mass into granules (cutting and optionally spheronising).

Preferably, step c) and d) are done by agglomeration, by mixing the mixture of step b) with the granulation agent in agglomerating equipment, which may be directly linked to the equipment used in step a) and b).

The weight ratio of the mixture of step b) to the granulation agent is preferably from 1:15 to 5:1, more preferably from 1:10 to 3:1, preferably from 1:6 to 2:1.

If the carrier material is liquid at temperatures below 40° C., the process step b) and also c) and d) could be conducted at temperatures below 40° C., provided the carrier stays a liquid. However, preferably, step b) is conducted and the mixture of step b), when mixed in step c), is kept on a temperature as described above, preferably between 40 or even 50 and 80° C. The exact temperature will depend on melting point of the carrier used: the temperature in step c) is typically kept above the melting point of the carrier to facilitate pumping and mixing.

The mixing step c) is preferably done by use of a high sheer mixer, having a (shaft) rotation speed of 500 rpm or more, typically 1000 rpm or more or even 1500 rpm or more, such as the CB Loedige mixer.

Thus, a solid component is obtained, which can be further processed in the required form. For example, it can be made into tablets, for example by compressing a certain amount together in a mould.

For ease of handling and for example incorporation into laundry and cleaning and/or care composition, it might be preferred to form granules of the solid component.

The desired particle sizes can also be achieved by further granulation, for example, by marumerizing, mechanically grinding the resulting solid component in blenders (e.g., an Oster® blender) or in large scale mills (e.g., a Wiley® Mill) to the desired particle size range or by prilling in a conventional manner (e.g., forcing the well-circulated co-melt through a heated nozzle into cooled atmospheric temperatures).

Preferred is granulation in a low sheer mixer, typically having a rotation speed of less than 500 rpm, preferably less than 300 rpm or even less than 200 rpm, such as a KM Loedige mixer.

Preferred may be that in step d) the mixture of c) is dusted with a powder to aid granulation, for example fine inorganic material with a weight mean particle size of less than 100 microns, preferably less than 50 microns or even less than 20 microns, such as for example zeolite.

Preferably, the process is such that after step c and/or d, fines and oversized granules are recycled. Preferably, the process thus comprises a screening step after step c) or preferably step d).

A fluid bed may be used to cool the granules, aid granulation and/or to aid screening of the granules. Typically, no drying step is needed and no drying takes place in the fluid bed.

The resulting granules preferably have a weight mean particle size of at least 200 microns or even at least 300 microns or at least 400 microns or even at least 500 microns, or even at least 600 microns, and typically up to 3000 microns or even to 2000 microns, or even to 1000 microns or even to 800 microns. Preferred may be a weight mean particle size between 500 and 750 microns. Preferred may thus be that fines of a particle size below for example 150 or even 250 microns are recycled, just as too coarse granules, for example above 1700 microns or even above 1200 microns.

The mean as used herein is calculated on a weight percent basis. The mean is determined by conventional analytical techniques such as, for example, laser light diffraction or microscopic determination utilizing a scanning electron microscope, or sieving with a number of sieves of different mesh sizes, typically at least 5 different mesh sizes. Preferably, greater than 50% by weight and more preferably greater than 60% by weight and most preferably greater than 70% by weight, of the particles have actual diameters which fall within the range of from about Preferably, the resulting solid composition, preferably granules, have a bulk density (repour) of between 450 g/l and 1100 g/l, more preferably from 500 g/l to 900 g/l or even 650 g/l to 750 g/l.

Preferred steps a), b) and c) and optionally d) are: In the first part of a TSE, the compounds to be reacted are brought at a temperature up to 50° C. and mixed together, whereby preferably also a second active material is added and mixed, at a screw speed between 150 rpm and 250 rpm, preferably 200 rpm, to make the resulting reaction product mixture. Typical weight rates of material introduced in the TSE are of 5 to 200 kg/hour for each of the compounds/active. The temperature within the reaction mixture is preferably within the range of 40 to 60° C. with a residence time between 10 and 45 seconds. Thereafter, the resulting product mixture is brought along the TSE for dispersion into a carrier, preferably a carrier having a melting point between 30° C. and 135° C., the carrier having been previously brought to a temperature between 40° and 150° C., at a rate of between 50 and 200 kg/hour, preferably 150 kg/hour. The dispersion temperature at the end of the TSE is then preferably about 70° C. and the total residence time of the mixture within the TSE is preferably between 10 seconds to 2 minutes. The resulting dispersion is then pumped to an agitated storage tank and then to an agglomerator, or directly into an agglomerator, such as the CB Loedige. The granulation agent is already present in the agglomerator, so that the dispersion is poured over the granulation agent. This is agglomerated together and then fed into a second mixer with lower sheer rate and a dusting agent is added. The resulting granules are screened and cooled and are ready for storage or for incorporation into a product.

Compounds to be Reacted

The reaction product of step a) is an active material. Typically, the compounds to be reacted include at least one active material, so that the reaction product is also an active material. The active material, when used herein, may be any material having an activity in use, in particular being active when deposited onto a surface. Preferred actives are actives which will provide a beneficial effect on the treated surface like fabrics; these are herein referred to as benefit agents. Hence, the active material or compound (or benefit agent) may be selected from a flavour ingredient, a pharmaceutical ingredient, a biocontrol ingredient, perfume composition, a refreshing cooling ingredient, malodour masking agents, fabric softeners, photobleaching agents, brighteners, anti-wrinkling agents, fabric integrity agents, sunscreens.

Typically, the total of active material comprises up to 70% weight of the solid component, more preferably to 60% or even to 50% or even to 40% or even to 25%, and typically at least 0.05 or even at least 1% or even at least 5% or even at least 10% by weight of the solid component.

Flavour ingredients include spices, flavor enhancers that contribute to the overall flavour perception.

Pharmaceutical ingredients include drugs, in particular skin or hair treatment or care products.

Biocontrol ingredients include biocides, antimicrobials, bactericides, fungicides, algaecides, mildew-cides, disinfectants, antiseptics, insecticides, vermicides, plant growth hormones.

Typical antimicrobials include Glutaraldehyde, Cinnamaldehyde, and mixtures thereof. Typical insect and/or moth repellants are perfume ingredients, such as citronellal, citral, N,N diethyl meta toluamide, Rotundial, 8-acetoxycarvotanacetone, and mixtures thereof. Other examples of insect and/or moth repellent for use herein are disclosed in U.S. Pat. Nos. 4,449,987, 4,693,890, 4,696,676, 4,933,371, 5,030,660, 5,196,200, and "Semio Activity of Flavor and Fragrance molecules on various Insect Species", B. D. Mookherjee et al., published in *Bioactive Volatile Compounds from Plants,* ASC Symposium Series 525, R. Teranishi, R. G. Buttery, and H. Sugisawa, 1993, pp. 35–48.

One preferred active herein is a perfume composition, described hereinafter in more detail.

The compounds are preferably to be reacted in a condensation reaction or Michael addition reaction, and the structure of compounds is thus preferably such that such type of reactions are possible. Preferred are esterification reactions and/or Schiff's Base reactions and/or amidation reactions, and/or polymersation reactions.

The compounds to be reacted are typically selected so as to provide the required viscosity of the resulting reaction product, as described herein. Preferably, these compounds will also provide that the resulting reaction product is water-insoluble.

The compounds to be reacted also comprise a compound which enables the deposition of the other reacted compound, (e.g. benefit agent), onto the surface. Preferably, this compound also protects the other compound (e.g. benefit agent) from oxidation and from diffusing in the aqueous environment. Preferred may be that such a compound is water-insoluble.

Preferably, the compounds to be reacted together comprise at least a polymeric material. Preferred is that the reaction product is a water-insoluble polymer reaction product.

Preferably, the compounds to be reacted together comprise an amine-based compound (which is a compound containing a primary, secondary and/or tertiary amine group, preferably at least a primary and/or secondary amine group). Preferred are polymeric amine compounds, to be reacted with one or more active compounds. The preferred amine compounds are described hereinafter.

Preferably, an active ingredient with an acid, anhydride, acid chloride, or more preferably aldehyde, ketone, ester, nitrile group, or mixtures of such groups, is reacted with a polymer in an esterification and/or Schiff's Base reaction and/or amidation reaction. Highly preferred is the reaction of an amine-containing polymer and an ester, aldehyde and/or ketone containing active compound.

Preferably, a second active material is mixed in the process of the invention with the reaction product. The second active ingredient may comprise, or may be, the same ingredient or ingredients as the active compound reacted in the reaction. Thus, the second active material may be any of the above mentioned actives, which is added in excess so not all is reacted, and part thus is present as second active material. For example, if using polymers as one of the compounds which is not an active as described above, and another compound to be reacted therewith, such as for example an aldehyde perfume, it is possible to adjust the ratio of the compounds used, such that some of the active compound (e.g. aldehydes perfume) remains unreacted. In this case, these unreacted-active compound can be part or all of the second active compound.

In a preferred execution, the second active comprises at least different, or even only different, active materials than the active compound reacted in the process. For example, the second active material can be another perfume composition than the perfume reacted in step a) of the process. The second active material can also be another type of active material (e.g. benefit agent, as described above), for example the active compound reacted may be a perfume composition and the second active material can be a biocidal control agent, fabric softener, photobleaching agent, brightener, anti-wrinkling agent, fabric integrity agent or sunscreen.

Perfume Composition

Perfume compositions typically comprise of one or a mixture of perfumes ingredients.

One typical perfume ingredient is a aldehyde perfume ingredient. Preferably, the perfume aldehyde is selected from adoxal; anisic aldehyde; cymal; ethyl vanillin; florhydral; helional; heliotropin; hydroxycitronellal; koavone; lauric aldehyde; lyral; methyl nonyl acetaldehyde; P. T. bucinal; phenyl acetaldehyde; undecylenic aldehyde; vanillin; 2,6,10-trimethyl-9-undecenal, 3-dodecen-1-al, alpha-n-amyl cinnamic aldehyde, 4-methoxybenzaldehyde, benzaldehyde, 3-(4-tert butylphenyl)-propanal, 2-methyl-3-(para-methoxyphenyl propanal, 2-methyl-4-(2,6,6-trimethyl-2(1)-cyclohexen-1-yl) butanal, 3-phenyl-2-propenal, cis-/trans-3,7-dimethyl-2,6-octadien-1-al, 3,7-dimethyl-6-octen-1-al, [(3,7-dimethyl-6-octenyl)oxy]acetaldehyde, 4-isopropylbenzyaldehyde, 1,2,3,4,5,6,7,8-octahydro-8,8-dimethyl-2-naphthaldehyde, 2,4-dimethyl-3-cyclohexen-1-carboxaldehyde, 2-methyl-3-(isopropylphenyl)propanal, 1-decanal; decyl aldehyde, 2,6-dimethyl-5-heptenal, 4-(tricyclo[5.2.1.0(2,6)]-decylidene-8)-butanal, octahydro-4,7-methano-1H-indenecarboxaldehyde, 3-ethoxy4-hydroxy benzaldehyde, para-ethyl-alpha, alpha-dimethyl hydrocinnamaldehyde, alpha-methyl-3,4-(methylenedioxy)-hydrocinnamaldehyde, 3,4-methylenedioxybenzaldehyde, alpha-n-hexyl cinnamic aldehyde, m-cymene-7-carboxaldehyde, alpha-methyl phenyl acetaldehyde, 7-hydroxy-3,7-dimethyl octanal, Undecenal, 2,4,6-trimethyl-3-cyclohexene-1-carboxaldehyde, 4-(3)(4-methyl-3-pentenyl)-3-cyclohexen-carboxaldehyde, 1-dodecanal, 2,4-dimethyl cyclohexene-3-carboxaldehyde, 4-(4-hydroxy-4-methyl pentyl)-3-cylohexene-1-carboxaldehyde, 7-methoxy-3,7-dimethyloctan-1-al, 2-methyl undecanal, 2-methyl decanal, 1-nonanal, 1-octanal, 2,6,10-trimethyl-5,9-undecadienal, 2-methyl-3-(4-tertbutyl)propanal, dihydrocinnamic aldehyde, 1-methyl-4-(4-methyl-3-pentenyl)-3-cyclohexene-1-carboxaldehyde, 5 or 6 methoxy0hexahydro4,7-methanoindan-1 or 2-carboxaldehyde, 3,7-dimethyloctan-1-al, 1-undecanal, 10-undecen-1-al, 4-hydroxy-3-methoxy benzaldehyde, 1-methyl-3-(4-methylpentyl)-3-cyclohexenecarboxaldehyde, 7-hydroxy-3,7-dimethyl-octanal, trans-4-decenal, 2,6-nonadienal, para-tolylacetaldehyde;

4-methylphenylacetaldehyde, 2-methyl-4-(2,6,6-trimethyl-1-cyclohexen-1-yl)-2-butenal, ortho-methoxycinnamic aldehyde, 3,5,6-trimethyl-3-cyclohexene carboxaldehyde, 3,7-dimethyl-2-methylene-6-octenal, phenoxyacetaldehyde, 5,9-dimethyl-4,8-decadienal, peony aldehyde (6,10-dimethyl-3-oxa-5,9-undecadien-1-al), hexahydro-4,7-methanoindan-1-carboxaldehyde, 2-methyl octanal, alpha-methyl-4-(1-methyl ethyl)benzene acetaldehyde, 6,6-dimethyl-2-norpinene-2-propionaldehyde, para methyl phenoxy acetaldehyde, 2-methyl-3-phenyl-2-propen-1-al, 3,5,5-trimethyl hexanal, Hexahydro-8,8-dimethyl-2-naphthaldehyde, 3-propyl-bicyclo[2.2.1]-hept-5-ene-2-carbaldehyde, 9-decenal, 3-methyl-5-phenyl-1-pentanal, methylnonyl acetaldehyde, 1-p-menthene-q-carboxaldehyde, citral, lilial, florhydral, mefloral, and mixtures thereof.

More preferred aldehydes are selected from citral, 1-decanal, benzaldehyde, florhydral, 2,4-dimethyl-3-cyclohexen-1-carboxaldehyde; cis/trans-3,7-dimethyl-2,6-octadien-1-al; heliotropin; 2,4,6-trimethyl-3-cyclohexene-1-carboxaldehyde; 2,6-nonadienal; alpha-n-amyl cinnamic aldehyde, alpha-n-hexyl cinnamic aldehyde, P.T. Bucinal, lyral, cymal, methyl nonyl acetaldehyde, trans-2-nonenal, lilial, trans-2-nonenal, lauric aldehyde, undecylenic aldehyde, mefloral and mixture thereof.

Another typical perfume ingredient is a ketone perfume ingredient. Preferably, the perfurme ketone is selected from buccoxime; iso jasmone; methyl beta naphthyl ketone; musk indanone; tonalid/musk plus; Alpha-Damascone, Beta-Damascone, Delta-Damascone, Iso-Damascone, Damascenone, Damarose, Methyl-Dihydrojasmonate, Menthone, Carvone, Camphor, Fenchone, Alpha-Ionone, Beta-Ionone, Gamma-Methyl so-called Ionone, Fleuramone, Dihydrojasmone, Cis-Jasmone, Iso-E-Super, Methyl-Cedrenyl-ketone or Methyl-Cedrylone, Acetophenone, Methyl-Acetophenone, Para-Methoxy-Acetophenone, Methyl-Beta-Naphtyl-Ketone, Benzyl-Acetone, Benzophenone, Para-Hydroxy-Phenyl-Butanone, Celery Ketone or Livescone, 6-Isopropyl-decahydro-2-naphtone, Dimethyl-Octenone, Freskomenthe, 4-(1-Ethoxyvinyl)-3,3,5,5,-tetramethyl-Cyclohexanone, Methyl-Heptenone, 2-(2-(4-Methyl-3-cyclohexen-1-yl)propyl)-cyclopentanone, 1-(p-Menthen-6(2)-yl)-1-propanone, 4-(4-Hydroxy-3-methoxyphenyl)-2-butanone, 2-Acetyl-3,3-Dimethyl-Norbornane, 6,7-Dihydro-1,1,2,3,3-Pentamethyl-4(5H)-Indanone, 4-Damascol, Dulcinyl or Cassione, Gelsone, Hexalon, Isocyclemone E, Methyl Cyclocitrone, Methyl-Lavender-Ketone, Orivon, Para-tertiary-Butyl-Cyclohexanone, Verdone, Delphone, Muscone, Neobutenone, Plicatone, Veloutone, 2,4,4,7-Tetramethyl-oct-6-en-3-one, Tetrameran, hedione, and mixtures thereof.

Highly preferred as (one of) the compound(s) to be reacted are selected from Alpha Damascone, Delta Damascone, Iso Damascone, Carvone, Gamma-Methyl-Ionone, Iso-E-Super, 2,4,4,7-Tetramethyl-oct-6-en-3-one, Benzyl Acetone, Beta Damascone, Damascenone, methyl dihydrojasmonate, methyl cedrylone, hedione, and mixtures thereof.

Still, the perfume composition may also be mixture of perfume ingredients including or not the above mentioned aldehyde or ketone.

Typical of these ingredients include fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Suitable perfumes are disclosed in U.S. Pat. No. 5,500,138, said patent being incorporated herein by reference.

Examples of perfume ingredients useful in the perfume compositions include, but are not limited to, amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; 4-tert-butyl-cyclohexyl acetate; alpha,alpha-dimethylphenethyl acetate; methylphenylcarbinyl acetate; cyclic ethyleneglycol diester of tridecandioic acid; 3,7-dimethyl-2,6-octadiene-1-nitrile; ionone gamma methyl; ionone alpha; ionone beta; petit-grain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho-[2,1b] furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsamn; fir balsam; hydroxycitronellal and indol; phenyl acetaldehyde and indol;

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine;

eugenol; vanillin; diphenyl oxide; hydroxycitronellal ionones; methyl ionones; isomethyl ionomes; ionomes; cis-3-hexenol and esters thereof; indane musk fragrances; tetralin musk fragrances; isochroman musk fragrances; macrocyclic ketones; macrolactone musk fragrances; ethylene brassylate. Also suitable herein as perfume ingredients of the perfume composition are the so-called Schiff base. Schiff's bases are the condensation of an aldehyde perfume ingredient with an anthranilate. A typical description can be found in U.S. Pat. No. 4,853,369. Typical of Schiff bases are selected from Schiff's base of 4-(4-hydroxy-4-methylpentyl)-3-cyclohexene-1-carboxaldehyde and methyl anthranilate; condensation products of: hydroxycitronellal and methyl anthranilate; 4-(4-hydroxy-4-methyl pentyl)-3-cyclohexene-1-carboxaldehyde and methyl anthranilate; Methyl Anthranilate and Hydroxy Citronellal commercially available under the tradename Aurantiol; Methyl Anthranilate and Methyl Nonyl Acetaldehyde commercially available under the tradename Agrumea; Methyl Anthranilate and PT Bucinal commercially available under the tradename Verdantiol; Methyl anthranilate and Lyral commercially available under the tradename Lyrame; Methyl Anthranilate and Ligustral commercially available under the tradename Ligantral; and mixtures thereof.

Preferably, the perfume compositions useful in the present invention compositions are substantially free of halogenated materials and nitromusks.

The perfume compositions are preferably characterised by having a low Odor Detection Threshold. Such Odor Detection Threshold (ODT) should be lower than 1 ppm, preferably lower than 10 ppb—measured at controlled Gas Chromatography (GC) conditions such as described here below. This parameter refers to the value commonly used in the perfumery arts and which is the lowest concentration at which significant detection takes place that some odorous material is present. Please refer for example in "Compilation of Odor and Taste Threshold Value Data (ASTM DS 48 A)", edited by F. A. Fazzalari, International Business Machines, Hopwell Junction, N.Y. and in Calkin et al., Perfumery, Practice and Principles, John Willey & Sons, Inc., page 243 et seq (1994). For the purpose of the present invention, the Odor Detection Threshold is measured according to the following method:

The gas chromatograph is characterized to determine the exact volume of material injected by the syringe, the precise split ratio, and the hydrocarbon response using a hydrocarbon standard of known concentration and chain-length distribution. The air flow rate is accurately measured and, assuming the duration of a human inhalation to last 0.02 minutes, the sampled volume is calculated. Since the precise concentration at the detector at any point in time is known, the mass per volume inhaled is known and hence the concentration of material. To determine the ODT of a perfume material, solutions are delivered to the sniff port at the back-calculated concentration. A panelist sniffs the GC effluent and identifies the retention time when odor is noticed. The average over all panelists determines the threshold of noticeability. The necessary amount of analyte is injected onto the column to achieve a certain concentration, such as 10 ppb, at the detector. Typical gas chromatograph parameters for determining odor detection thresholds are listed below.

GC: 5890 Series II with FID detector

7673 Autosampler

Column: J&W Scientific DB-1

Length 30 meters ID 0.25 mm film thickness 1 micrometer

Method:

Split Injection: 17/1 split ratio

Autosampler: 1.13 microliters per injection

Column Flow: 1.10 mL/minute

Air Flow: 345 mL/minute

Inlet Temp. 245° C.

Detector Temp. 285° C.

Temperature Information

Initial Temperature: 50° C.

Rate: 5C./minute

Final Temperature: 280° C.

Final Time: 6 minutes

Leading assumptions: 0.02 minutes per sniff

GC air adds to sample dilution

Examples of such preferred perfume components are those selected from: 2-methyl-2-(para-iso-propylphenyl)-propionaldehyde, 1-(2,6,6-trimethyl-2-cyclohexan-1-yl)-2-buten-1-one and/or para-methoxy-acetophenone. Even more preferred are the following compounds having an ODT £ 10 ppb measured with the method described above: undecylenic aldehyde, undecalactone gamma, heliotropin, dodecalactone gamma, p-anisic aldehyde, para hydroxy-phenylbutanone, cymal, benzyl acetone, ionone alpha, p.t.bucinal, damascenone, ionone beta, methyl-nonyl ketone, methyl heptine carbonate, linalool, indol, cis-3-hexenyl salicylate, vanillin, methyl isobutenyl tetrahydropyran, ethylvanillin, coumarin, ethyl methyl phenyl glycidate, eugenol, methylanthranilate, iso eugenol, beta naphtol methyl ester, herbavert, lyral, allyl amyl glycolate, dihydro iso jasmonate, ethyl-2-methylbutyrate, nerol, and phenylacetaldehyde. Most preferably the perfume composition comprises at least 5%, more preferably at least 10% of such components.

Also preferred perfume ingredients are those as described in WO 96/12785 on page 12–14. Even most preferred are those perfume compositions comprising at least 10%, preferably 25%, by weight of perfume ingredient with an ClogP of at least 2.0, preferably at least 3.0, and boiling point of at least 250° C. still another preferred perfume composition is a composition comprising at least 20%, preferably 35%, by weight of perfume ingredient with an ClogP at least 2.0, preferably at least 3.0, and boiling point of less than or equal to 250° C.

Clog P is a commonly known calculated measure as defined in the following references "Calculating log $P_{oct}$ from Structures"; Albert Leo (Medicinal Chemistry Project, Pomona College, Claremont, Calif. USA. Chemical Reviews, Vol. 93, number 4, June 1993; as well as from Comprehensive Medicinal Chemistry, Albert Leo, C. Hansch, Ed. Pergamon Press: Oxford, 1990, Vol. 4, p.315; and Calculation Procedures for molecular lipophilicity: a comparative Study, Quant. Struct. Act. Realt. 15, 403–409 (1996), Raymund Mannhold and Karl Dross.

Preferred Amine-Compounds to be Reacted

Examples of compounds to be reacted with another compound an active material, such as a benefit agent, are carboxylic acid or carboxylate compounds or amine compounds; which can be any carboxylic acid- or carboxylate-compound capable of forming an ester or amide reaction product, or which can be any amine-compound which forms an amine reaction product; preferably a product of reaction of a compound containing a primary amine functional group and/or secondary amine functional group with an active ester, nitrile, ketone and/or aldehyde containing component. A typical disclosure of amine reaction product suitable for use herein can be found in recently filed applications EP 98870227.0, EP 98870226.2, EP 99870026.4, and EP 99870025.6, all incorporated herein by reference.

By "primary and/or secondary amine", it is meant a compound which carries at least one primary and/or secondary amine and/or amide function.

Of course, one amine compound may carry both primary and secondary amine compound, thereby enabling the reaction with several aldehydes and/or ketones.

In particular when the amine compound is reacted with a perfume composition, or the mixture of step a) comprises a perfume composition, the primary amine and/or secondary amine compound is also characterized by an Odour Intensity Index of less than that of a 1% solution of methylanthranilate in dipropylene glycol.

Odour Intensity Index Method

By Odour Intensity Index, it meant that the pure chemicals were diluted at 1% in Dipropylene Glycol, odor-free solvent used in perfumery. This percentage is more representative of usage levels. Smelling strips, or so called "blotters", were dipped and presented to the expert panelist for evaluation. Expert panelists are assessors trained for at least six months in odor grading and whose gradings are checked for accuracy and reproducibility versus a reference on an on-going basis. For each amine compound, the panelist was presented two blotters: one reference (Me Anthranilate, unknown from the panelist) and the sample. The panelist was asked to rank both smelling strips on the 0–5 odor intensity scale, 0 being no odor detected, 5 being very strong odor present.

Results:

The following represents Odour Intensity Index of an amine compound suitable for use in the present invention and according to the above procedure. In each case, numbers are arithmetic averages among 5 expert panelists and the results are statistically significantly different at 95% confidence level:

| | |
|---|---|
| Methylanthranilate 1% (reference) | 3.4 |
| Ethyl-4-aminobenzoate (EAB) 1% | 0.9 |
| 1,4-bis-(3-aminopropyl)-piperazine (BNPP) 1% | 1.0 |

A general structure for the primary amine compound of the invention is as follows:

$$B—(NH2)_n;$$

wherein B is a carrier material, and n is an index of value of at least 1.

Compounds containing a secondary amine group have a structure similar to the above excepted that the compound comprises one or more —NH— groups instead of —NH2. Further, the compound structure may also have one or more of both —NH2 and —NH— groups.

Preferred primary and/or secondary amines inorganic (not having a carbon in the backbone) compounds for the reaction herein are those selected from mono or polymers or organic-organosilicon copolymers of amino derivatised organo silane, siloxane, silazane, alumane, aluminum siloxane, or aluminum silicate compounds. Typical examples of such carriers are: organosiloxanes with at least one primary amine moiety like the diaminoalkylsiloxane [H2NCH2 (CH3)2Si]O, or the organoaminosilane (C6H5) 3SiNH2 described in: Chemistry and Technology of Silicone, W. Noll, Academic Press Inc. 1998, London, pp 209, 106).

Preferred primary and/or secondary amines also include those selected from aminoaryl derivatives, polyamines, amino acids and derivatives thereof, substituted amines and amides, glucamines, dendrimers, polyvinylamines and derivatives thereof, and/or copolymer thereof, alkylene polyamine, polyaminoacid and copolymer thereof, cross-linked polyaminoacids, amino substituted polyvinylalcohol, polyoxyethylene bis amine or bis aminoalkyl, aminoalkyl piperazine and derivatives thereof, bis(amino alkyl)alkyl diamine linear or branched, and mixtures thereof.

Preferred aminoaryl derivatives are the amino-benzene derivatives including the alkyl esters of 4-amino benzoate compounds, and more preferably selected from ethyl-4-amino benzoate, phenylethyl-4-aminobenzoate, phenyl-4-aminobenzoate, 4-amino-N'-(3-aminopropyl)-benzamide, and mixtures thereof.

Polyamines suitable for use in the present invention are polyethyleneimines polymers, poly[oxy(methyl-1,2-ethanediyl)], α-(2-aminomethylethyl)-ω-(2-aminomethylethoxy)-(=C.A.S No. 9046-10-0); poly[oxy(methyl-1,2-ethanediyl)], α-hydro-)-ω-(2-aminomethylethoxy)-, ether with 2-ethyl-2-(hydroxymethyl)-1,3-propanediol (=C.A.S. No. 39423-51-3); commercially available under the tradename Jeffamines T403, D-230, D-400, D-2000; 2,2',2"-triaminotriethylamine; 2,2'-diamino-diethylamine; 3,3'-diamino-dipropylamine, 1,3 bis aminoethyl-cyclohexane commercially available from Mitsubishi and the C12 Sternamines commercially available from Clariant like the C12 Sternamin(propylenamine), with n=¾, and mixtures thereof. Preferred polyamines are polyethyleneimines commercially available under the tradename Lupasol like Lupasol HF (MW 25000), P (MW 750000), PS (MW 750000), SK (MW 2000000), SNA (MW 1000000).

Preferred amino acids for use herein are selected from tyrosine, tryptophane, lysine, glutamic acid, glutamine, aspartic acid, arginine, asparagine, phenylalanine, proline, glycine, serine, histidine, threonine, methionine, and mixture thereof, most preferably selected from tyrosine, tryptophane, and mixture thereof. Preferred amino acid derivatives are selected from tyrosine ethylate, glycine methylate, tryptophane ethylate, and mixture thereof.

Preferred substituted amines and amides for use herein are selected from nipecotamide, N-coco-1,3-propenediamine; N-oleyl-1,3-propenediamine; N-(tallow alkyl)-1,3-propenediamine; 1,4-diamino cyclohexane; 1,2-diamino-cyclohexane; 1,12-diaminododecane, and mixtures thereof.

Other primary amine compounds suitable for use herein are the glucamines, preferably selected from 2,3,4,5,6-pentamethoxy-glucamine; 6-acetylglucamine, glucamine, and mixture thereof.

Also preferred compounds are the polyethylenimine and/or polypropylenimine dendrimers and the commercially available Starburst® polyamidoamines (PAMAM) dendrimers, generation G0-G10 from Dendritech and the dendrimers Astromols®, generation 1–5 from DSM being DiAminoButane PolyAmine DAB (PA)x dendrimers with $x=2^n\times4$ and n being generally comprised between 0 and 4.

Polyamino acid are also suitable and preferred class of polymers to be reacted in step a) of the process herein. Polyaminoacids are compounds which are made up of amino acids or chemically modified amino acids. They can contain alanine, serine, aspartic acid, arginine, valine, threonine, glutamic acid, leucine, cysteine, histidine, lysine, isoleucine, tyrosine, asparagine, methionine, proline, tryptophan, phenylalanine, glutamine, glycine or mixtures thereof. In chemically modified amino acids, the amine or acidic function of the amino acid has reacted with a chemical reagent.

This is often done to protect these chemical amine and acid functions of the amino acid in a subsequent reaction or to give special properties to the amino acids, like improved solubility. Examples of such chemical modifications are benzyloxycarbonyl, aminobutyric acid, butyl ester, pyroglutamic acid. More examples of common modifications of amino acids and small amino acid fragments can be found in the Bachem, 1996, Peptides and Biochemicals Catalog.

Preferred polyamino acids are polylysines, polyarginine, polyglutamine, polyasparagine, polyhistidine, polytryptophane or mixtures thereof. Most preferred are polylysines or polyamino acids where more than 50% of the amino acids are lysine, since the primary amine function in the side chain of the lysine is the most reactive amine of all amino acids.

The preferred polyamino acid has a molecular weight of 500 to 10.000.000, more preferably between 2.000 and 25.000.

The polyamino acid can be cross linked. The cross linking can be obtained for example by condensation of the amine group in the side chain of the amino acid like lysine with the carboxyl function on the amino acid or with protein cross linkers like PEG derivatives. The cross linked polyamino acids still need to have free primary and/or secondary amino groups left for reaction with the active ingredient.

The preferred cross linked polyamino acid has a molecular weight of 20.000 to 10.000.000, more preferably between 200.000 and 2.000.000.

The polyamino acid or the amino acid can be co-polymerized with other reagents like for instance with acids, amides, acyl chlorides. More specifically with aminocaproic acid, adipic acid, ethylhexanoic acid, caprolactam or mixture thereof. The molar ratio used in these copolymers ranges from 1:1 (reagent/amino acid (lysine)) to 1:20, more preferably from 1:1 to 1:10.

The polyamino acid like polylysine can also be partially ethoxylated.

Examples and supply of polyaminoacids containing lysine, arginine, glutamine, asparagine are given in the Bachem 1996, Peptides and Biochemicals catalog.

The polyaminoacid can be obtained before reaction with the active ingredient, under a salt form. For example polylysine can be supplied as polylysine hydrobromide. Polylysine hydrobromide is commercially available from Sigma, Applichem, Bachem and Fluka.

Examples of suitable amino functional polymers containing at least one primary and/or secondary amine group for the purpose of the present invention are:

Polyvinylamine with a MW of about 300-2.10E6;

Polyvinylamine alkoxylated with a MW of about 600, 1200 or 3000 and an ethoxylation degree of 0.5;

Polyvinylamine vinylalcohol—molar ratio 2:1, polyvinylaminevinylformamide—molar ratio 1:2 and polyvinylamine vinylformamide-molar ratio 2:1;

Triethylenetetramine, diethylenetriamine, tetraethylenepentamine;

Bis-aminopropylpiperazine;

Polyamino acid (L-lysine/lauric acid in a molar ratio of 10/1), Polyamino acid (L-lysine/aminocaproic acid/adipic acid in a molar ratio of 5/5/1), Polyamino acid (L-lysine/aminocaproic acid/ethylhexanoic acid in a molar ratio of 5/3/1) Polyamino acid (polylysine-cocaprolactam); Polylysine; Polylysine hydrobromide; cross-linked polylysine, amino substituted polyvinylalcohol with a MW ranging from 400–300,000;

polyoxyethylene bis[amine] available from e.g. Sigma;

polyoxyethylene bis[6-aminohexyl] available from e.g. Sigma;

N,N'-bis-(3-aminopropyl)-1,3-propanediamine linear or branched (TPTA); and 1,4-bis-(3-aminopropyl)piperazine (BNPP).

The more preferred compounds are selected from ethyl-4-amino benzoate, polyethyleneimine polymers commercially available under the tradename Lupasol like Lupasol WFG20 waterfree, PR8515, HF, P, PS, SK, SNA; the diaminobutane dendrimers Astramol®, polylysine, cross-linked polylysine, N,N'-bis-(3-aminopropyl)-1,3-propanediamine linear or branched; 1,4-bis-(3-aminopropyl)piperazine, and mixtures thereof. Even most preferred compounds are those selected from ethyl-4-amino benzoate, polyethyleneimine polymers commercially available under the tradename Lupasol like Lupasol WF, G20 waterfree, PR8515, HF, P, PS, SK, SNA; polylysine, cross-linked polylysine, N,N'-bis-(3-aminopropyl)-1,3-propanediamine linear or branched, 1,4-bis-(3-aminopropyl)piperazine, and mixtures thereof.

Moreover, the primary and/or secondary amine compound may also be reacted with additional compounds (other than the compounds described above to be active compounds or benefit agents), to form reaction products with the required viscosity (for example acyl halides, like acetylchloride, palmytoyl chloride or myristoyl chloride, acid anhydrides like acetic anhydride, alkylhalides or arylhalides to do alkylation or arylation, aldehydes or ketones, glutaraldehyde, unsaturated ketones, aldehydes or carboxylic acids like 2-decylpropenoic acid, propenal, propenone).

Liquid Carrier Material

The liquid carrier material may be any material which is liquid under the process conditions, other than the compounds reacted together or other than the optional second active material.

Preferred are materials which are solid at room temperature, e.g. at 20° C. or even at 25° C. or even at 30° C., but in molten state during the process conditions. Preferably, the melting point of the carrier material is between 25° C. or even 30° C. or even 40° C. and 200° C. or even 150° C. or even 135° C. or even 100° C. or even 80° C.

Preferably, for the purpose of the invention, when the process is to make a suspendable material, the carrier also has a viscosity from 500 or even from 700 to 100,000 or even 70,000 cps.

Highly preferred are carrier materials which do not react with the product or mixture formed in step a) of the process of the invention.

Highly preferred are organic nonionic material, including nonionic surfactants. Preferred carrier material include liquids conventionally used in cleaning products as solvents, such as alcohols, glycerols.

Preferred are alkoxylate-containing materials. Preferred are polyalkoxylated compounds, such as polyalkoxylated esters, polyalkoxylated amines, polyalkoxylated amides, polyalkoxylated alcohols, preferably poly ethoxylated compounds. Preferred average alkoxylation degrees are at least 25, or even at least 40 or even at least 70. Also useful herein as carrier are quaternary oligoamine oligomers, preferably alkoxylated quaternary oligoamines, more preferable polyethoxylated quaternary diamines, preferably having an alkoxylation degree of 10 to 40, or even 16 to 26, preferably the quaternary amine groups being spaced apart by 2 carbon atoms or more, preferably by 4 carbon atoms or more, or even at 6 or more carbon atoms, preferably this being alkylene moieties.

Preferred carrier materials include polyalkoxylated alcohols such as tallow alcohol polyethoxylates, such as TAE80.

Also preferred are polyethylene glycols, preferably with an weight average molecular weight of more than 400, preferably more than 2000 or even more than 3000, for example PEG 4000.

Also useful as carrier can be anionic surfactants, cationic surfactants, amphoteric surfactants, zwitterionic surfactants and/or amphiphilic surfactants.

Other preferred carriers include silicone materials. Preferred are non-volatile silicone fluids such as polydimethyl siloxane gums and fluids, such as linear silicone polymer fluids having the formula $(CH_3)3SiO[(CH3)2SiO]mSi(CH)3$ where m is 0 or more and whereby m has an average value such that the viscosity at 25° C. of the silicone fluid is preferably 5 centistokes or more, more preferably 500 centistokes or more, the silicone fluid preferably having a weight average molecular weight of 800 or more, preferably 25,000 or more; or such as volatile silicone fluid which can be a cyclic silicone fluid of the formula [(CH3)2SiO]n where n ranges between about 3 to about 7, preferably about 5 or 6; or such as silicone surfactants, such as polyglycolethers; other suitable silicone surfactants are described in 'Silicone Surfactants', by R. M. Hill, ISBN 0-8247-0010-4, 1999, Marcel Dekker Inc. New York, Basel. These silicone surfactants can be ABA type copolymers, grafted copolymers or ter- or tri-siloxane polymers. The silicone surfactants can be silicone polyether copolymers and can have ethylene oxide, propylene oxide or butylene oxide based chains and/or mixtures thereof. More preferably the silicone surfactant has a weight average molecular weight of more than 1000, more preferably more than 5000. The silicone or silicone surfactants can be a fluorosilicone as well, preferably a fluorosilicone with a viscosity of at least 1000 centistokes.

Suitable examples of silicone for use herein as carrier include silicones commercially available from Dow Corning Corporation like the DC3225C; DC5225C and DC246 for cyclic silicones; silicone glycols ethers like DC5200, DC1248, DC190; the DC 244 Fluids, DC 245 Fluids, DC 344 Fluids, or DC 345 Fluids, or ABIL K4, ABIL B 8839 for the cyclomethicone, or the DC 200 fluids, ABIL K 520 (hexamethyl disiloxane), ABIL 10 to ABIL 100000 (dimethicone), ABIL AV 8853 (Phenyl dimethicone) for the linear silicones; Dow Corning's FS1265 fluorosilicone.

Still another suitable carrier is a combination of various silicone materials and/or other carriers, such as those described herein before. Preferably, one or more silicone material(s) is (are) emulsified or microemulsified in one or more other silicone materials, forming thus the suspendable component or the mixture of step b) herein.

Preferably, at least 80% or even 90% of such a silicone mixture is formed by 2 silicone materials. Then, the weight ratio of a first silicone material to a second silicone material in such a mixture is preferably from 1:50 to 2:1, more preferably 1:19 to 3:2, or even 1:9 to 1:1.

Preferably, the carrier for suspendable components formed by the process herein is selected from glycols and/or silicones, described above, most preferably is selected from silicones. Preferably, the carrier for solid components formed by the process herein is selected from nonionic surfactants, alkoxylated compounds, including alkoxylated alcohol nonionic surfactants, alcohols, glycerols and/or (polyalkylene) glycols.

Solid Granulation Agent

The solid granulation agent can be any material which is solid under the reaction conditions, other than the compounds reacted with another. Preferred are inorganic or organic acids or salts. The granulation agent should be such that it does not react with the reaction product of step a). Preferred are anhydrous materials.

Highly preferred are solid granulation agents in powder form having a weight mean particle size of from 1 to 200 microns, preferably up to 150 microns or even up to 100 microns.

Preferred are organic carboxylic acid or salts thereof, such as citric acid, fumaric acid, maleic acid, maleic acid, aspartic acid.

Also conventional chelating agents, including phosphonate chelating agents are suitable herein.

More preferred are inorganic materials such as inorganic salts, including bicarbonates, carbonates, sulphates, phosphates, amorphous and crystalline (layered) silicates, including aluminosilicates. Preferred salts are salts of sodium, potassium or magnesium.

Highly preferred is the use of at least a carbonate salt or an aluminosilicate or mixtures thereof.

Preferred are also mixtures of granulation agents, for examples mixtures of inorganic salts or mixtures of organic acids and inorganic salts, including effervescing mixtures such as carboxylic acids and (bi)carbonates.

Optional Ingredients of Viscous Mixture

The product or mixture of step a or b) can be further mixed with plasticisers like phtalates, with tactifiers like rosin acids or rosin esters, cross linking agents like bifunctional aldehydes, or with thickeners. These agents can give the polymer the proper carrier characteristics like the required viscosity if the viscosity is not high enough. Of course, other known viscosity enhancer may be used herein for that purpose.

Compositions Comprising the Solid Component Formed in the Process

The solid component obtainable by the process herein may be incorporated in any product which requires the presence of the reacted product, such as cleaning compositions, fabric care composition, pharmaceutical compositions, biocidal compositions, typically laundry cleaning or fabric care composition. Means of incorporation the solid component into compositions (such as into the laundry and/or cleaning and/or fabric composition) are conventionally known in the art.

The compositions may also be liquid, for example in a spray, foam, or aerosol form which for example can be suitable for use while ironing, or applied on the surfaces of the tumble dryer. Then, the solid component is typically present as a suspended particle. Laundry compositions encompass laundry detergent compositions, including liquid, solid form like powdered, tablets as well as softening compositions including rinse added softening composition as well as dryer added softening compositions.

Preferably, the solid component herein is in granular form and mixed with other granular ingredients by dry-addition. Preferably, the finished composition is a detergent composition, more preferably in solid form, preferably granular form or tablet form (e.g. made from a granular composition).

The laundry cleaning or care compositions herein may comprise any additional ingredients, including the active materials described above, in addition to the solid component obtained by the process herein.

A conventional disclosure of softening ingredients to be used in the softening composition of the invention can be found in EP 98870227.0, incorporated herein by reference, which typically include components selected from a surfactant like a quaternary ammonium softening component, a stabilising agent like a nonionic ethoxylated surfactant, a chelating agent, a crystal growth inhibitor, a soil release agent, a polyalkyleneimine component, brighteners, preservatives, antibacterials, cyclodextrins, and mixtures thereof.

A conventional disclosure of a laundry or cleaning composition can be found in EP-A-0,659,876 and European patent application No. 98870226.2 which are both incorporated herein by reference.

| A | B | C | D | E | F | G |
|---|---|---|---|---|---|---|
| Damascone | Polyethylene amine | perfume | TAE80 | Carbonate salt (Na) | anionic surfactant | hydrotrope |
| Tripal | Lupasol P | Geraniol | PEG4000 | zeolite | brightner | bifunctional aldehyde cross-linker |
| Carvone | Lupasol WF | Eugenol | nonionic surfactant | sulphate salt | | gluteraldehyde |
| Benzyl acetone | Ethyl-4-amino benzoate | citronellol | glycerol | silicate | | thickener |
| Ionone | Astramol | biocide | alcohol | citric acid/salt | | glycerol |
| Damascone | Polylysine | Benzalkonium salt | ethoxylated$C_{12}C_{18}$ alcohol surfactant EO = 3–11 | clay | | cumene sulphonate |
| Aldehyde perfume | | amino oxide | | | | PEG |
| Cinnamaldehyde | | photobleach | | | | |
| Glutar aldehyde | | zinc compound | | | | |
| Citronellal | | | | | | |
| Citral | | | | | | |

Preferred are surfactants, builders, bleach, enzymes, suds suppressors, chelants, softening agents such as silicones and clay. Typical laundry or cleaning composition comprises a detergent and/or cleaning ingredient. Typical of bleaching systems include a peroxyacid, or a bleach precursor with a source of alkaline hydrogen peroxide necessary to form a peroxyacid bleaching species in the wash solution.

EXAMPLES

The following process in accord with the invention was used to first form a viscous reaction product and then forming a solid component from this viscous product, by introducing any of one or more of A, any of one or more of B, any of one or more of C, any of one or more of D, any of one or more of E, and optionally F and/or G, as set out in the table below, as follows:

In the first part of a Twin Screw Extruder, compound A and B and optionally compound G or part thereof, which are all water-free and brought at a temperature of 40° C., are added to react and also compound C was added, and this was all mixed at a screw speed of 150 to 250 rpm to make the resulting reaction product mixture. For example, compound A was typically introduced at a of 40 kg/hour and compound B at a speed of 60 kg/hour and compound C at a speed of 20 kg/hour. In the second part of the TSE, the resulting reaction product is dispersed into compound D, brought at a temperature of 70° C., for example at a rate of 120 kg/hour for compound D and 80 kg. The total production rate was thus 240 kg/hour. Then, this was transferred continuously into a Loedige CB mixer, and agglomerated with compound E and optionally compound F.

The resulting granules were screened for size and preferably cooled in a fluid bed, or vise versa. Preferred granules have for example a mean particle size of between 300 and 800 microns. Optionally, the granules were dusted with a fine powder, such as fine carbonate salt or zeolite, e.g. of a mean particle size below 20 microns.

Further Process Examples:

Example I

In the first part of the TSE, the Damascone brought at a temperature to ensure it is liquid, or even brought at a temperature of 60° C. and Lupasol WF (water free) with a perfume mixture and/or antimicrobial, preferably also brought at a temperature of 60° C., are mixed at a screw speed of 300 rpm to make the resulting amine reaction product with the perfume mixture, at a weight ratio of 120 kg/hour Damascone and 80 kg/hour of Lupasol WF (water free) with perfume mix at 200 kg/hour In the second part of the TSE, the reaction product/perfume mixture is dispersed into TAE80 brought at a temperature of 70° C. at a rate of 800 kg/hour. The total production rate was thus 1200 kg/hour.

The above mixture is agglomerated with 400 kg of carbonate and 50 kg to 100 kg zeolite/hour.

Example II

In the first part of the TSE, the Lilial brought at a temperature of 60° C. and Lupasol WF (water free) with a perfume mixture and/or antimicrobial, brought at a temperature of 60° C. are mixed at a screw speed of 150 rpm to make the resulting amine reaction product with the perfume mixture, at a weight ratio of 30 kg/hour Lilial and 20 kg/hour of Lupasol WF (water free) with perfume mix at 50 kg/hour In the second part of the TSE, the amine reaction product/perfume mixture is dispersed into TAE80 brought at a temperature of 70° C. at a rate of 120 kg/hour. The total production rate was thus 220 kg/hour.

The above mixture is agglomerated with 350 kg of carbonate and/or zeolite/hour

Example III

A perfume mix with the following composition in weight %

| | |
|---|---|
| Methyl Nonyl Acetaldehyde | 15 |
| Undecylenic Aldehyde | 30 |
| Triplal | 35 |
| Lauric Aldehyde | 19.5 |
| Iris Aldehyde | 0.5 |

which is in the first part of the TSE, is brought at a temperature of 60° C. and then, Lupasol WF (water free) with the perfume mixture brought at a temperature of 60° C. are mixed at a screw speed of 150 rpm to make the resulting amine reaction product with remaining perfume mixture, at a weight ratio of 60 kg/hour of the perfume mix and 20 kg/hour of Lupasol WF. In the second part of the TSE, the amine reaction product/perfume mixture is dispersed into PEG4000 brought at a temperature of 70° C. at a rate of 120 kg/hour. The total production rate was thus 200 kg/hour. The above mixture is agglomerated with a mixture of carbonate and zeolite (ratio being 5/1) at 350 kg/hour.

Any type of perfume mixture may be used. One preferred composition of the perfume mix is as follows:

| | |
|---|---|
| Citronellol | 7 |
| Geraniol | 7 |
| Linalool | 7 |
| Para Tertiary Butyl Cyclohexyl Acetate | 10 |
| Phenyl Ethyl Alcohol | 19 |
| Habanolide | 4.5 |
| Para Methoxy Acetophenone | 1.5 |
| Benzyl Acetate | 4 |
| Eugenol | 2 |
| Phenyl Ethyl Acetate | 5 |
| Verdyl Acetate | 6 |
| Verdyl Propionate | 4 |
| Hexyl Cinnamic Aldehyde | 3 |
| Ionone Gamma Methyl | 2 |
| Methyl Cedrylone | 10 |
| P.T. Bucinal | 7 |
| Para Cresyl Methyl Ether | 1 |

Example IV

In the first part of the TSE, the Damascone brought at a temperature of 60° C. and Lupasol WF (water free) with a perfume mixture and/or antimicrobial brought at a temperature of 60° C. are mixed at a screw speed of 150 rpm to make the resulting amine reaction product with the perfume mixture, at a weight ratio of 30 kg/hour Damascone and 20 kg/hour of Lupasol WF (water free) with perfume mix at 50 kg/hour In the second part of the TSE, the amine reaction product/perfume mixture is dispersed into a silicone mixture DC200 and DC5225 (ratio 1:1) and brought at a temperature of 60° C. at a rate of 120 kg/hour. The total production rate was thus 2200 kg/hour.

The synthesised "carried composition" may be used as is or may be further processed to enable easy incorporation into finished product.

VI-Synthesis Example of a Carrier and a Perfume Mix Benefit Agent

In a reaction vessel of 250 ml, 8 gms of perfume mix FC1 and 2.5 g of waterfree Lupasol WF is mixed together for 30 minutes hours at room temperature. The temperature of the reaction mixture, during the mixing, is controlled via a thermostat and not allowed to go higher than 80 C. After mixing the mixture is kept overnight in a waterbath at 60 C. The product thus obtained is a mixture of Lupasol completely reacted with molar proportions of each of the aldehydes of FC1 (see below), and unreacted aldehydes of FC1. All of the Lupasol WF is assumed to be reacted. The viscosity of the synthesised product is 190.000 cps.

FC1:

| | |
|---|---|
| Methyl Nonyl Acetaldehyde | 15 |
| Undecylenic Aldehyde | 30 |
| Triplal | 35 |
| Lauric Aldehyde | 19.5 |
| Iris Aldehyde | 0.5 |

Processing of the carried composition is done as follows: 80 g of one of the carried composition as above synthesised is mixed in an Ultra Turrax containing 120 g of dispersing carrier, e.g. TAE80 for 5 minutes, the temperature of mixing being of about 70° C. (melting temperature of the carrier), and the speed of the mixer being sufficient so as to maintain such temperature substantially constant. Temperature and time will depend on the nature of the dispersing carrier but are conventional steps to the skilled man. The resulting mixture is maintained at a temperature substantially equal to the melting point of the carrier material. Once the mixture is at a suitable temperature, it is poured onto the coating material i.e. carbonate and agglomerated in an electrical mixer like a Braun Mixer. Care is also taken that the temperature during the mixing does not substantially exceed the melting point of the carrier material. For example, 150 g of a mixture containing 90 g TAE80 and 60 g of the carried composition is poured at 60° C. into a Braun Mixer containing 300 g of carbonate. The mixing of the ingredients is carried out for about 5 minutes. Care is also taken that the temperature during the mixing does not exceed 65° C. Again, temperature and time will depend on the nature of the coating agent but are conventional steps to the skilled man.

The carried composition may also be mixed with a silicone suspending material, to form a composition which can be suspended in liquid products, such as liquid detergents or fabric care products.

What is claimed is:

1. A process for making a viscous reaction product and making this into a solid component, comprising the steps of:

a) reacting an amine with a member selected from the group consisting of esters, aldehydes, ketones and mixtures thereof without the presence of added free-moisture to form a first active material as a viscous mixed product which has a viscosity of at least 500 cps or even at least 1000 cps at 20° C. and mixing a second active material with the first active material, wherein the second active material is a perfume mix, brightener, soil release polymer, softening agent, bleaching agent, malodour masking agent or insect repellent;

b) mixing the product of step a) with a liquid carrier material; and c) mixing the mixture of step b) with a solid granulation agent to form said solid component.

2. The process of claim 1 wherein the liquid carrier material has a melting point above 30° C. and the temperature of the viscous mixed product of step a) and/or the liquid carrier material is such that the liquid carrier material is in its molten state.

3. The process of claim 1 wherein step b) is done by dispersing the viscous mixed product of step a) into the carrier material.

4. The process of claim 1 wherein step c) is done by pouring or spraying the mixture of step b) on the granulation agent.

5. The process of claim 1 wherein the reaction in step a) is a condensation reaction or Michael addition reaction.

6. The process of claim 1 wherein the viscosity of the viscous mixed product of step a) is at least 5000 cps or even at least 10,000 cps, at 20° C.

7. The process of claim 1 wherein the ratio of the first active material to the second active material in step a) is from 4:1 to 1:9.

8. The process of claim 1 wherein the liquid carrier material is a nonionic organic material.

9. The process of claim 1 wherein the granulation agent is one or more powders having a mean particle size of less than 100 microns.

10. The process of claim 1 wherein the weight ratio of the liquid carrier material to the reaction product is from 1:2 to 15:1.

11. The process of claim 1 wherein the weight ratio of the resulting mixture of step b) to the granulation agent is from 1:10 to 3:1.

12. The process of claim 1 wherein the esters, aldehydes or ketones reacted with the amine in step a) to form the first active material comprise a perfume or perfume mix.

13. The process of claim 1 wherein the amine of step a) is a polymeric amine.

14. The process of claim 13 wherein the polymeric amine is polyethyleneimine.

15. The process of claim 1 wherein the esters, aldehydes or ketones reacted with the amine in step a) comprise a biocontrol ingredient.

16. The process of claim 15 wherein the amine is polyethyleneimine.

17. The process of claim 1 wherein the esters, aldehydes or ketones reacted with the amine in step a) comprise an insect repellant.

18. The process of claim 17 wherein the amine is polyethyleneimine.

19. The process of claim 1 further comprising the additional step of adding a cross-linking compound and/or thickening agent.

20. The process of claim 1 further comprising:

d) forming the solid component of step c) into granule.

21. The process of claim 20 wherein the mean particle size of the granules formed in step d) is at least 500 microns.

* * * * *